United States Patent [19]

Roselli

[11] Patent Number: 4,553,715

[45] Date of Patent: Nov. 19, 1985

[54] EXTENDIBLE LINE

[76] Inventor: Federico Roselli, 6961 Russell Ave., Burnaby, British Columbia, Canada, V5J 4R8

[21] Appl. No.: 646,701

[22] Filed: Aug. 31, 1984

[51] Int. Cl.[4] ..... B65H 75/38

[52] U.S. Cl. ..... 242/100; 242/106; 242/107.6; 211/119.1

[58] Field of Search ..... 242/100, 106, 107.6, 242/96, 99, 84.8, 68.3; 211/119.1, 119.15

[56] References Cited

U.S. PATENT DOCUMENTS

| | | | |
|---|---|---|---|
| 84,919 | 12/1968 | Stevens . | |
| 901,896 | 10/1908 | Ferber | 242/84.8 |
| 1,027,655 | 5/1912 | Johnson . | |
| 1,111,489 | 9/1914 | Palmer . | |
| 1,856,223 | 5/1932 | Mirick . | |
| 2,132,548 | 10/1938 | Stockwell et al. . | |
| 2,261,629 | 11/1941 | Murphy . | |
| 2,269,808 | 1/1942 | Cabassa | 242/99 X |
| 2,377,640 | 6/1945 | Miller . | |
| 2,384,914 | 9/1945 | Hoagland . | |
| 2,438,188 | 3/1948 | Thrower | 242/99 |
| 2,634,919 | 4/1953 | Strassler | 242/84.8 |
| 2,893,655 | 7/1959 | Carlson . | |
| 3,809,331 | 5/1974 | Gaul . | |

*Primary Examiner*—Stuart S. Levy
*Assistant Examiner*—Lloyd D. Doigan
*Attorney, Agent, or Firm*—Christie, Parker & Hale

[57] ABSTRACT

A device to store and pay out a line. The device has a casing with a reel located in the casing. The line is located on the reel. There is an opening in the casing through which the line can pass. An abutment is within the casing and a handle in the reel is movable from an outward position to a retracted position. The outward position enables turning of the reel to wind or unwind the line within the casing to stop rotation.

5 Claims, 3 Drawing Figures

EXTENDIBLE LINE

FIELD OF THE INVENTION

This invention relates to a device for paying out, retrieving and storing clothes lines.

DESCRIPTION OF THE PRIOR ART

The simplest of conventional clothes lines consists of a length of flexible cord or wire secured between two points a suitable distance above the ground. Although economical this arrangement is far from ideal as the cord is usually permanently in position as ravelling the cord into a convenient manageable size each time the line is not in use can be tedious. When the cord is in position it creates an obstacle in such limited areas as bathrooms, campers or small apartments.

SUMMARY OF THE INVENTION

The present invention therefore seeks to provide a simple, reliable means of putting up and removing a clothes line with a minimum of time and effort. The invention also provides a means of ensuring that the line stays in place, at suitable tension, when put up. Furthermore the invention permits simple storing of a clothes line in a neat, untangled manner by means of a reel, when the clothes line is not in use.

Thus, according to its broadest aspect, the present invention is a device to store and pay out a line comprising a casing; a reel located in the casing; means to locate the line on the reel; an opening in the casing through which the line can pass; an abutment within the casing; a handle in the reel movable from an outward position to a retracted position, the outward position enabling turning of the reel to wind or unwind the line and the inward position acting to abut the abutment within the casing to stop rotation.

BRIEF DESCRIPTION OF THE DRAWINGS

The invention is illustrated, merely by way of example, in the accompanying drawings in which.

DESCRIPTION OF THE PREFERRED EMBODIMENT

Figure 1:
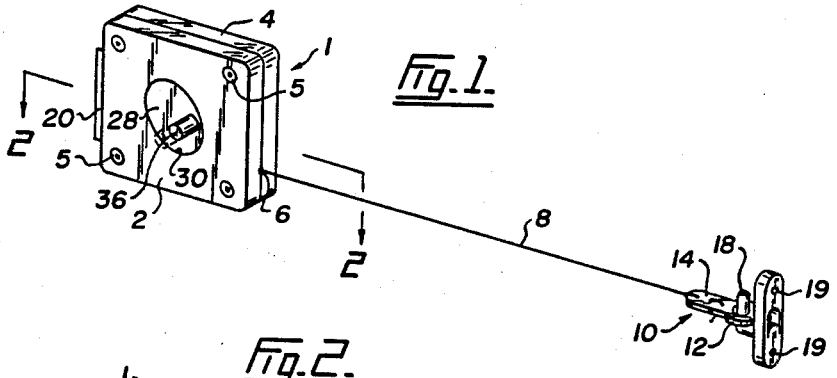
FIG. 1 is a perspective view of the device according to the present invention.

The drawings show a device to store and pay out a line comprising a casing 1 made up of case members 2 and 4 held together by screws 5 in conventional manner. There is a circular opening 6 in the casing from which a clothes line 8 emerges. Engagement means 10 in the form of circular ring 12 and a tail portion 14 having a plurality of small holes 16 is engaged on the clothes line 8.

The circular ring 12 engages on a hook 18 that can be secured to a flat surface by means of screws extending through holes 19. The hook 18 is typically mounted on the wall of, for example, a bathroom.

The casing 1 is adapted to be mounted on an opposite wall by means of a housing 20 on the outside of the casing 1, half of the housing 20 being formed on member 2 and the other half on member 4. The housing 20 slidably engages a catch 22, mounted in the wall with the screws. A flange 24 at the bottom of the catch 22 provides a stop to prevent the casing 1 sliding off the catch.

Figure 2:
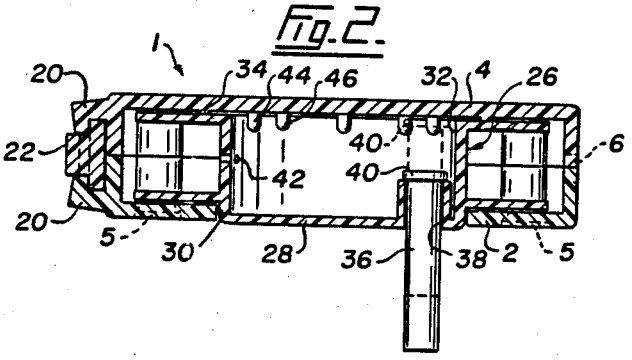
FIG. 2 is a section on the line 2—2 in FIG. 1.
Figure 3:
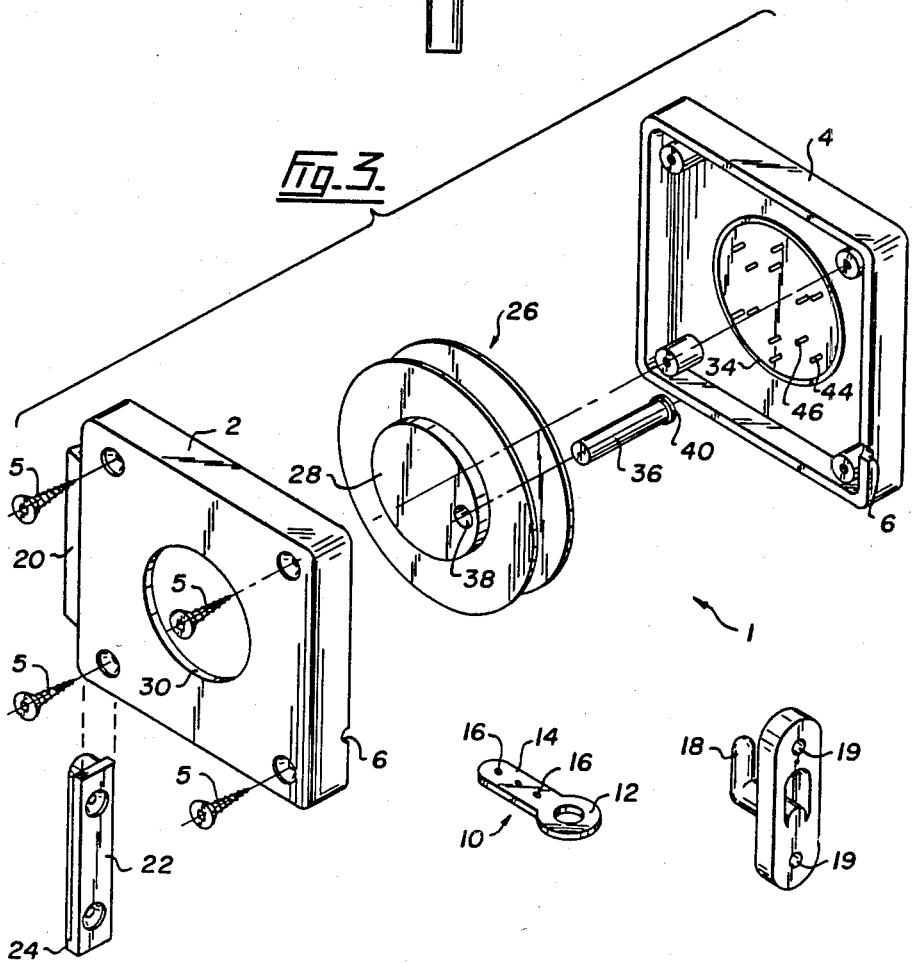
FIG. 3 is an exploded view of the device shown in FIG. 1.

There is a reel 26 mounted within the casing 1 by a circular projection 28 engaging in opening 30 in casing member 2 on one side. There is a recess 32 on the other side that, to reduce friction, runs in contact with the raised circular lip 34 formed in casing member 4. Cylindrical handle 36 extends through a hole 38 in the outer periphery of reel 26. Flange 40 at the end of the handle 36 prevents accidental removal through the hole 38—see FIG. 2. Reel 26 is formed with a hole 42 to secure the end of the cord 8.

Reel 26 engages outer projections 44 formed on casing member 4. Further projections 46 are spaced inwardly from the projections 44.

The spaced pairs of projections 44 and 46 form an abutment for the handle 36 to prevent rotation of the reel when the handle 36 is pushed inwardly. However when the handle is pulled outwardly, as shown in broken lines in FIG. 1 and solid lines in FIG. 2, the reel can be rotated to allow a line to be payed out or collected in.

The invention is useful in the following way. Catch 22 is rigidly secured to a wall located at one end of the bathroom or the like by screws. Casing 1 is slidably mounted on the catch 22 by pressing the casing downwardly until it engages stop 24. Hook 18 is mounted by screws to a wall at some convenient distance from the catch 22 and the casing assembly mounted on the catch 22. Handle 36 is pulled outwardly to disengage flange 40 on handle 36 from the projection of 44 and 46. This allows reel 26 to spin freely and member 10 can be gripped and pulled to pay out the line.

The circular ring of member 10 is placed over the hook 18. Any remaining slack in the line is then removed by turning the handle 36. Once the desired tension has been achieved the handle is pushed inwardly to re-engage projection 44 and 46 to prevent further movement of the reel.

To draw in or retract the line member 10 is disengaged from hook 18. Handle 36 is pulled outwardly and rotated to draw in line 8.

For long term storage the casing 1 can be removed from catch 22 and stored. Catch 22 and hook 18 desirably remain in position on the wall as they do not occupy any appreciable space.

The device is typically made of molded plastic. The line 8 may be of nylon.

The present invention thus provides a simple yet efficient and compact piece of equipment to store and pay out a line. It is particularly appropriate in the use of a clothes line, for example in any location where space is restricted as in a camper, trailer or even an apartment.

I claim:

1. A device to store and pay out a line comprising:

a casing;

a reel located in the casing and having an open side;

a plurality of discrete projections on the housing to engage the open side of the reel to guide the reel, the discrete projections extending radially inwardly of the casing;

means to locate the line on the reel;

an opening in the casing through which the line can pass;

a handle in the reel movable from an outward position to a retracted position, the outward position enabling rotation of the reel to wind or unwind the line and the inward position enabling the handle to abut the projections within the casing to stop rotation.

2. A device as claimed in claim 1 in which the reel has a projection on the side opposite its open side;

a corresponding opening in the housing to receive the projection to assist in locating the reel.

3. A device as claimed in claim 1 including a housing on the outside of the casing to engage a bracket.

4. A device as claimed in claim 1 including a line.

5. A device as claimed in claim 6 in which the line has engagement means to engage a wall mount.

* * * * *